United States Patent [19]

Storandt

[11] 4,273,355

[45] Jun. 16, 1981

[54] SKI SAFETY BINDING

[75] Inventor: Ralf Storandt, Leonberg, Fed. Rep. of Germany

[73] Assignee: Vereinigte Baubeschlagfabriken, Gretsch & Co. GmbH, Leonberg, Fed. Rep. of Germany

[21] Appl. No.: 80,015

[22] Filed: Sep. 28, 1979

[30] Foreign Application Priority Data

Oct. 27, 1978 [DE] Fed. Rep. of Germany ..... 2846914

[51] Int. Cl.[3] ..... A63C 9/086

[52] U.S. Cl. ..... 280/614; 280/618; 280/619

[58] Field of Search ..... 280/614, 615, 635, 618, 280/619, 620, 617

[56] References Cited

U.S. PATENT DOCUMENTS

| | | | |
|---|---|---|---|
| 3,901,523 | 8/1975 | Burger | 280/614 |
| 4,002,354 | 1/1977 | Ramer | 280/614 |

FOREIGN PATENT DOCUMENTS

| | | | |
|---|---|---|---|
| 2527616 | 2/1976 | Fed. Rep. of Germany | 280/614 |
| 1474992 | 3/1967 | France | 280/614 |
| 150334 | 1/1932 | Switzerland | 280/619 |

*Primary Examiner*—David M. Mitchell

[57] ABSTRACT

A ski safety binding of the type which is convertible between downhill and touring configurations comprises a base plate connectable to a ski via a safety release mechanism and a sole plate, to which a ski boot can be fastened, which is arranged for pivotal movement about a transverse pivot axis located adjacent the toe of the ski boot on the base plate to define the touring configuration. At least one fitting is provided on at least one side of the binding for securing the sole plate to the base plate in the downhill configuration. The, or each, fitting comprises a link incorporating a spring at its forward end and which extends between a point of attachment at the forward part of the base plate and a point at which it is held to the rear of the sole plate at the side thereof. A hook like projection on the base plate is located between the point of attachment of the link on the base plate and the point at which it is held to the sole plate and somewhat below this point and the link can be engaged beneath, or removed from the projection in order to convert the binding between the downhill and touring configurations—even when a ski boot is engaged in the binding.

In a preferred arrangement, with two fittings on either side of the ski, the link is in the form of a cable which runs around the back of the ski boot and forms a part of a toggle lever clamp which secures the heel of the ski boot to the sole plate. An abutment on the cable arranged in front of the side projection on the base plate restricts the flexibility of the sole clamp in the downhill configuration.

23 Claims, 5 Drawing Figures

SKI SAFETY BINDING

Figure 1:
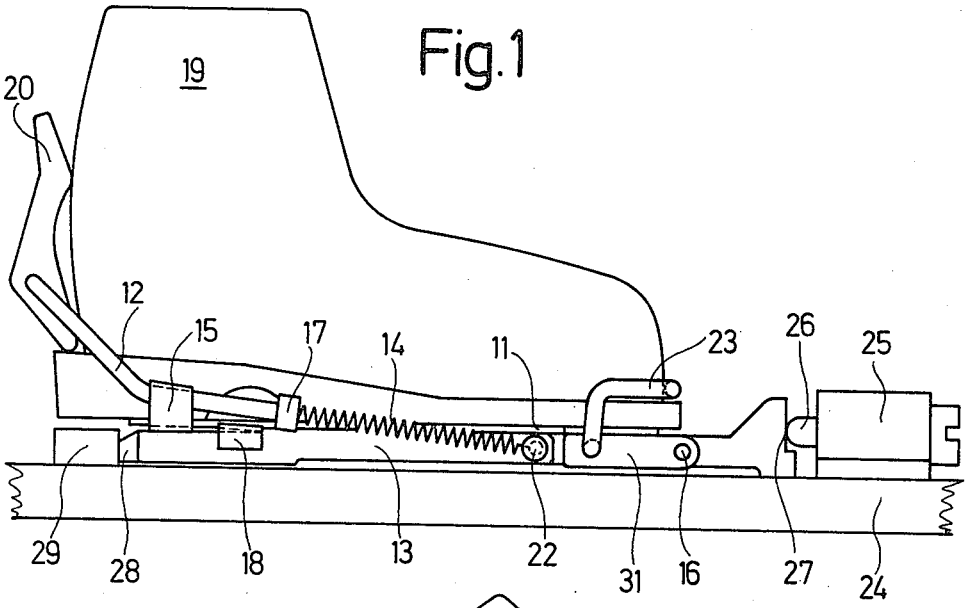

The invention relates to a ski safety binding and has particular reference to a ski safety binding of the plate type and which is convertible between downhill and touring configurations.

Known systems include arrangements in which a base plate is connectable to a ski via a safety release mechanism and a sole plate, to which a ski boot can be attached, is arranged for pivotal movement about a transverse pivot axis on the base plate to define said touring configuration. The arrangement is so contrived that the binding can be converted so that the sole plate and base plate are held together to define the downhill configuration.

Examples of such plate type safety ski bindings are described in German Patent Publications Nos. DE-OS 24 56 559 and DE-OS 25 27 616. The above described type of arrangement has the advantage that the movements during touring take place exclusively between the sole plate and the base plate. In this way the release function of the safety release mechanism between the base plate and the ski remains independent of whether the binding is adjusted for downhill skiing or for touring. It is, however, a disadvantage of the known plate type ski safety bindings that to effect the conversion from the downhill to the touring configuration and vice versa the ski boot must be first removed from the binding.

In one of the known plate type ski safety bindings (DE-OS No. 24 56 559) the conversion from downhill skiing to touring takes place by bending the flexibly constructed base plate upwardly at its middle to free its free end from the device which secures it to the base plate. This procedure, in the same manner as the reverse procedure of securing the sole plate to the base plate, is only possible when the ski boot is removed from the binding.

In the other named plate type ski binding (DE-OS No. 25 27 616) a cable loop, which passes around the heel of the ski boot, is secured at its free ends in side disposed bores in either the stiffly constructed sole plate or in the base plate to respectively define the touring and downhill configurations. The conversion between these two configurations is once more only readily possible after the ski boot has been removed from the binding.

A principal object of the present invention is thus to provide a ski safety binding of the kind set out above and in which the conversion between downhill and touring configurations, and vice versa, can be carried out in simple manner without it being necessary to remove the ski boot from the binding.

To satisfy this object there is thus provided in accordance with the present invention a ski safety binding which is convertible between downhill and touring configurations the binding comprising a base plate connectable to a ski via a safety release mechanism, a sole plate to which the ski boot can be fastened arranged for pivotal movement about a transverse pivot axis on the base plate to define said touring configuration and at least one fitting provided on at least one side of the binding for securing the sole plate to the base plate in the downhill configuration; said fitting comprising a link incorporating a spring member at its forward portion and extending at least between a point of attachment at the forward part of the base plate and a point at which it is held to the side of the sole plate at the rear portion thereof, a projection on the base plate and which is disposed between said point of attachment and the point at which the link is held to the sole plate and somewhat below the latter, and an abutment on the link which is located in front of and close to the projection when, to define the downhill configuration, the link is engaged beneath this projection.

In this manner the conversion from the touring to the downhill configuration is simply effected by engaging the link beneath the projection which is conveniently of hook-like form. This can be done with the binding closed but even if the binding must be temporarily released or relaxed for a short time in order to engage the link beneath the slide projection this is still a significant improvement in contrast to the known plate type ski bindings because the ski boot can remain in position on the sole plate.

Although the invention can in principle be realized with only a single said fitting on one side of the binding it is, however, preferred that two such fittings are provided one on each side of the binding.

A significant feature of the subject of the application is the provision of a suitable relationship between the distance from the point at which the link is held to the side of the sole plate to its point of attachment at the base plate, and the distance from this point of attachment at the base plate to the transverse pivot axis. The ready engageability of the link beneath the side projection is still ensured even when the forward point of attachment to the base plate coincides with the transverse pivot axis. Preferably, however, the forward point of attachment to the base plate lies a defined distance behind the transverse pivot axis because a restoring moment is then exerted on the upwardly pivoted ski boot during touring which, in desired manner, increases as the ski boot and the attached sole plate pivot further away from the base plate. This resetting force has the advantage that the skier, e.g. when climbing on the mountain, can lift the entire ski by raising the leg to which it is attached and the ski does not flap downwardly in uncontrolled manner. Furthermore, the increase of the resetting force which occurs on pivotal movement of the ski boot corresponds to the increase of the resetting force which arises in customary touring bindings in which the tip of a ski shoe is held by a toe binding which is not upwardly pivotable.

It is of especial advantage when the distance from the point at which the link is held to the side of the sole plate to its point of attachment at the base plate lies in the range from three to five times, and preferably approximately four times, the distance from the point of attachment to the base plate to the transverse pivot axis between the sole plate and the base plate.

It is especially advantageous if the link associated with each said fitting comprises a cable passing from the spring element to the tensioner arranged at the heel of a ski boot and wherein the cable can slide relative to the point at which it is held to the sole plate and relative to said projection. In this way the cable with the spring member has a double function. Thus on the one hand in the touring configuration it acts as the fitting which secures the sole plate to the base plate and, on the other hand, in both the touring and downhill configurations it acts as a heel binding for the ski boot which secures the ski boot to the sole plate. The cable pulls the ski boot downwardly and forwardly where it is held in a suitable front binding. Although it is basically possible to secure the link or cable associated with each fitting to the point at which it is held at the side of the sole plate, in which case the cable part between the point of attachment to the sole plate and the tensioner must be constructed to be elastically resilient, it is preferred that the cable be arranged to slide in the longitudinal direction relative to the point at which it is held on the sole plate. This point can conveniently be formed as a simple eye or lug-like projection.

This is particularly of great advantage when, in accordance with a specially preferred embodiment of the invention, the sole plate is flexibly constructed. A flexibly constructed sole plate of this kind is particularly well suited for use in connection with customary resilient ski touring boots or shoes. By reason of the flexible sole plate touring boots of this kind are not stiffened during touring so that the soles of the boots can deflect and bend in a natural fashion during touring. In this connection it is of course necessary that the cable can slide relative to the point at which it is held to the side of the sole plate. In this embodiment the spring member which is inserted in the cable must generate a sufficient spring force for securing the ski boot to the sole plate and this force must also be sufficient in the downhill configuration in which the sole plate and the base plate are secured together. The pre-tension in the spring is thus determined with these considerations in mind. The necessary resetting force in the touring configuration can then be freely chosen by a suitable choice of the distance from the point of attachment to the base plate to the transverse pivot axis.

The tensioner at the rear end of the cable is preferably constructed as a toggle lever through which the cable runs from one side of the binding to the other.

A further advantageous embodiment is characterized in that the point at which the link is held to the side of the sole plate is so constructed that it simultaneously forms a sideways abutment for the sole of the ski boot. The boot is thus securely held to the sole plate in the side direction.

In order to be able to effect the conversion between downhill and touring configurations and vice versa, without opening the binding, the projection on the base plate should be spaced by a sufficient distance from the point at which the cable is held to the side of the sole plate that the cable can be engaged beneath the projection and removed therefrom by hand, even when the ski boot is engaged in the binding and the tensioner is closed to tension the cable.

The abutment on the link or cable is usefully constructed as a ring arranged on the link or cable. In the downhill configuration this ring abuts, at least after a trivial lifting of the sole plate, against the side projection on the base plate so that from this moment on the effect of the spring which is located between the abutment and the point of attachment of the link or cable to the base plate is neutralized. The heel of the ski boot is thus directly held via the tensioner, the cable, the abutment and the side projection from the base plate to the base plate without the spring member enabling play in the upward direction.

The spring member is usefully a tension spring which extends between the abutment and the point of attachment on the base plate.

The sole clamp arranged at the forward region of the sole plate for securing the toe portion of the ski boot is usefully constructed as a wire loop of the kind which automatically adjusts its position to accommodate different sole thicknesses in manner known per se.

A further embodiment is so constructed that the link or spring member can be connected by means of pins or screws or the like to side disposed bores of the base plate. In this connection several bores are preferably arranged one behind the other in the base plate and the side projection on the base plate and the point at which the cable is held to the side of the sole plate can be arranged at various corresponding positions on the base plate and the sole plate respectively.

This embodiment allows the binding to be suited to different ski boot sizes. A displacement of the link in the longitudinal direction of the ski has the effect that the spacing of the forward point of attachment from the transverse pivot axis is changed. This is very advantageous because the resetting force in the touring configuration is then automatically increased on displacement rearwardly of the point of attachment of the link to the base plate such as occurs when the binding is adjusted to suit larger ski boot sizes. As in general heavier people have larger ski boots this is a favourable effect.

A separate adjustment in the longitudinal direction of the ski for the projection on the base plate is particularly advantageous because in this way the vertical elasticity of the binding in the downhill position can be changed within wide limits.

Figure 2:
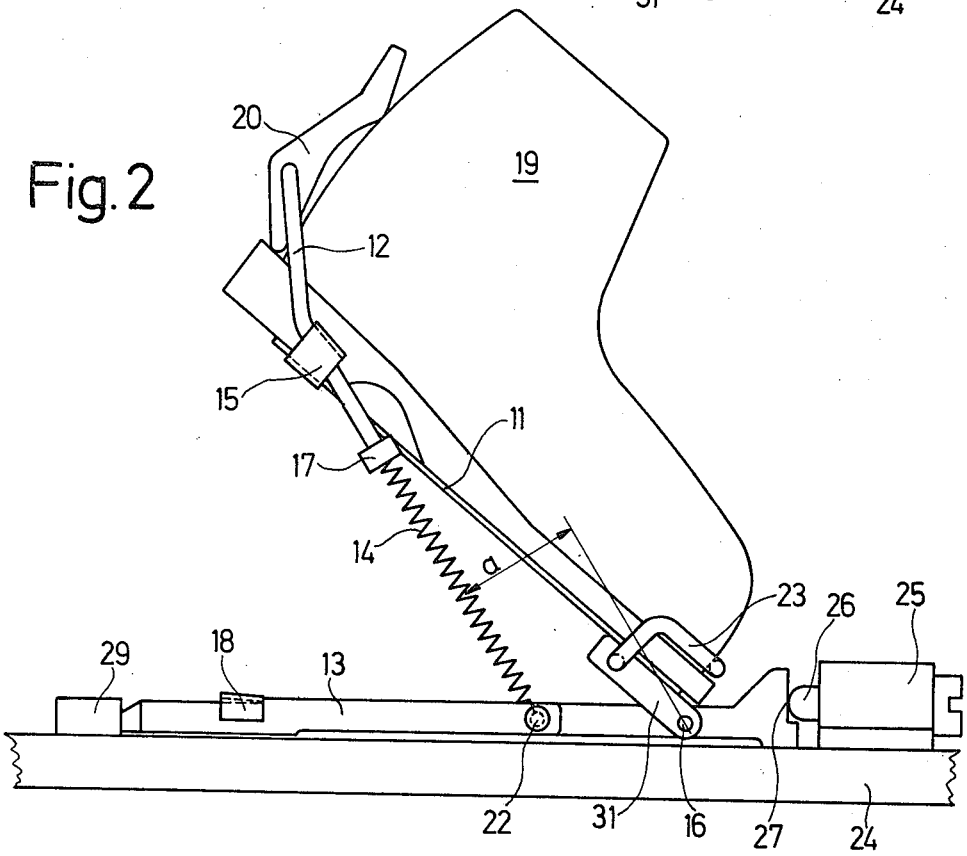
Figure 3:
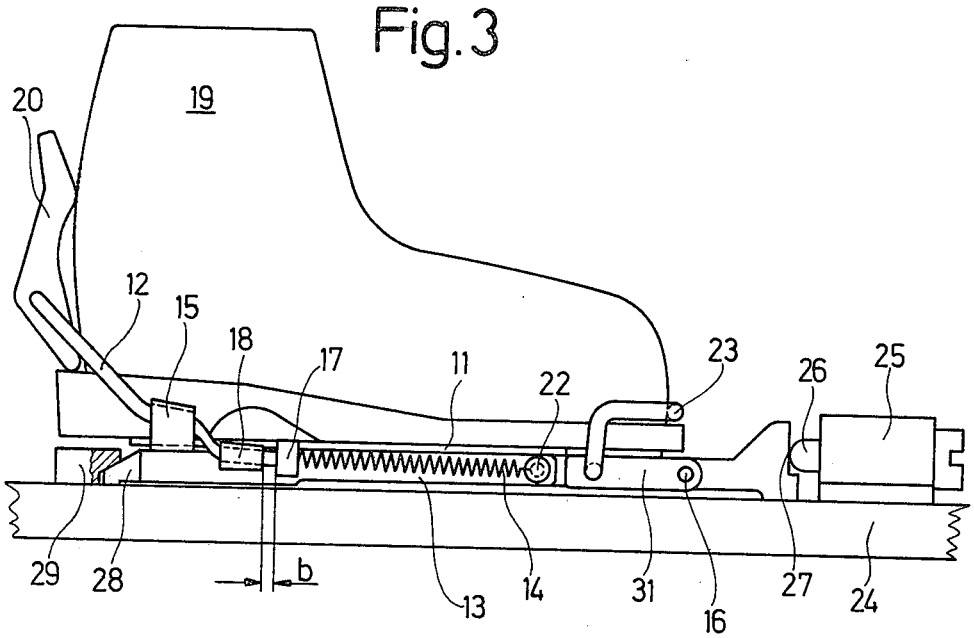
Figure 4:
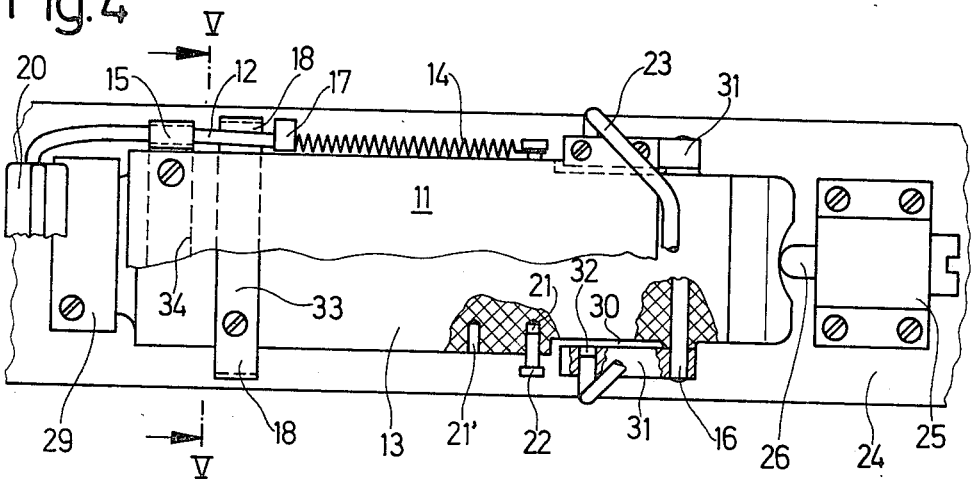
Figure 5:
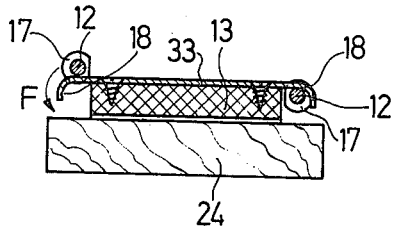

The invention will now be described in more detail by way of example only and with reference to the accompanying drawings in which are shown:

FIG. 1 a schematic side view of a plate type safety ski binding in accordance with the invention and to which a ski boot is attached, the binding being illustrated in the touring configuration in the position in which the sole plate contacts the base plate;

FIG. 2 a side view similar to that of FIG. 1 but showing the ski boot in the upwardly pivoted position;

FIG. 3 a view similar to that of FIG. 1 but showing the binding in the downhill skiing configuration;

FIG. 4 a partly sectioned plan view of the binding of FIG. 1 in the touring configuration and FIG. 5 a section on the line V—V of FIG. 4 in which the touring configuration is illustrated to the left and the downhill configuration to the right and in which the sole plate has been omitted.

Referring now to the drawings there can be seen a base plate 13 which has approximately the length of a ski boot 19 and which is secured in known manner to the ski 24 via a safety release mechanism. The safety release mechanism comprises a piston 26 which is resiliently mounted for movement in the longitudinal direction within a housing 25 and which engages in a correspondingly profiled seat 27 at the front end of the base plate 13. At its rear end the base plate 13 engages, by means of an upwardly chamfered projection 28, in a holder 29 which is fixed to the ski. In this manner the base plate 13 can be released from the ski in all directions on the occurrence of an excessive load on the leg of the skier, such as may e.g. be experienced during a fall. Other known forms of safety mechanism can be arranged between the base plate 13 and the ski 24 which are suitable for the purposes of the present teaching.

At is forward region the base plate has cut-outs 30 at its sides in which are housed two arms 31 which are connected together at their forward ends by a transverse pivot 16 which is journalled in the base plate. A flexible thin sole plate 11 which can be of synthetic material is screwed to the top of the arms 31 and extends rearwardly to the region occupied in operation by the heel of the ski boot 19. The transverse pivot 16 thus defines a transverse pivot axis between the sole plate and the base plate.

The arms 31 are additionally used for carrying a sole clamp 23 for securing the toe portion of the ski boot to the sole plate. The sole clamp 23 is in the form of a wire loop the two ends of which are journalled in side bores 32 of the arms 31. As can be seen in FIGS. 3 and 4 the wire loop extends over the sole plate and is spaced therefrom and serves to secure the toe of the ski boot 19 in the illustrated manner. As can be seen from the drawings the shape of the wire loop 23 and the arrangement of the pivot bores 32 behind the point at which the wire loop bears on the ski boot means the wire loop automatically adjusts its height to match the height of the sole of the ski boot when the ski boot is pressed forwardly, i.e. in the longitudinal direction of the ski.

The described construction allows the sole plate 11 to be pivoted upwardly from the position of FIG. 1 into the position of FIG. 2 about a transverse pivot axis 16, and of course in the reverse direction, and this pivotal movement is characteristic of the operation of the binding in the touring configuration.

The heel of the ski boot is secured to the sole plate by a toggle lever 20 which forms part of a pair of identical fittings provided one to either side of the binding and which serve not only to secure the sole plate to the base plate to define the downhill configuration but also play a significant role in the touring configuration.

As seen in the drawings each fitting basically comprises a link 12 including a spring member 14 and is so arranged that the link 12 is held by a suitably shaped clip to the rear portion of the sole plate 11 at its side and is secured at a point of attachment 22 to the base plate 13.

In the downhill configuration the spring member 14 may have a pre-tension in the range of 5 to 15 kp, preferably 10 kp, and a spring constant in the range of 0.1 to 0.4 kp per mm, preferably 0.2 kp/mm (kp being the unit of force kilopond, equivalent to 9.81 Newtons).

A hook-like side projection 18 is provided on the base plate 13 between the point of attachment of the link to the base plate and the point at which it is held to the side of the sole plate and somewhat below the latter. The link member can be engaged beneath the hook-like side projection 18 to secure the binding in the downhill configuration and an abutment 17 provided on the link member is arranged close to the side projection so that, in the downhill configuration, it restricts the degree of possible rearward movement of the link member and thus ensures that the toggle lever 20 securely holds the ski boot in position on the binding.

The specific arrangement features the provision of two transverse bores 21, 21' one behind the other in each of the side faces of the base plate somewhat behind the cutouts 30. Pins or bolts 22 are inserted or threaded into the bores 21 and the spring members 14 of each fitting respectively extend rearwardly from the pin or bolt to approximately the arch of the ski boot 19. The tension spring 14 finishes at its rearward end at a ring-like abutment 17 to which the cable is fastened and from which the cable extends rearwardly through the eye-like lug or clip 15 to the toggle lever tensioner 20 at the rear of the ski boot and then around the rear of the ski boot to the other side of the binding where it forms a part of the completely symmetrical fitting on the other side of the binding.

As can be seen particularly clearly from FIG. 4 the clips or lugs 15 which secure the cable to the side of the sole plate and the hook like side projections 18 which are provided on the base plate are spaced apart by a small distance from each other. It is essential for the invention that the projections 18 lie somewhat lower than the projections 15 as can be seen from FIGS. 1 and 3. The clips or lugs 15 can in similar fashion to the projections 18 be of hook like downwardly directed form so that the cable is securely held to the side of the sole plate but can, nevertheless, slide relative to the clips or lugs 15.

The vertical positions of the projections 18 are chosen so that the cable 12, in the manner shown in FIGS. 1, 3 and 5 can be readily guided above or below the projections.

The clips or lugs 15 on the sole plate 11 are spaced apart in the sideways direction by a distance equivalent to the width of the sole of the ski boot 19 so that the ski boot 19 can abut against the inner side surfaces of the clips and is thus securely held in the sideways direction.

Because the cable 12 does not need to be removed from the clips 15 these clips can be formed as eyes with bores which allow the cable to slide in the longitudinal direction of the ski instead of open at their underside as are the hook like side projections 18.

The manner of operation of the ski safety binding is as follows:

In the touring configuration the cable 12 extends, as seen in FIGS. 1, 2, 4 and in the left hand side of FIG. 5, above the side projections 18. For ski touring the ski boot can now be pivoted upwardly together with the sole plate 11 as a unit about the transverse pivot axis 16 as is illustrated in FIG. 2. Because the sole plate 11 is flexibly constructed the ski boot can additionally elastically deflect which is anatomically very favourable to the skier. As the ski boot pivots further away from the ski an increasing returning or resetting force is exerted on the ski boot due to the progressive increase in tension in the springs 14. The increase of the resetting force is not only brought about by the increasing travel of the spring but also by the continuous increase of the lever arm 'a' which is illustrated in FIG. 2. This lever arm is, however, of zero length in the base position of FIG. 1.

In order to convert the binding to the downhill configuration for downhill skiing the ski boot is first of all brought into the position shown in FIG. 1 in which the sole plate is in contact with the base plate. The cable 12 is now pressed beneath the side projections 18 into the position which can be seen from FIG. 3 and the right hand half of FIG. 5. This takes place without it being necessary to open the toggle lever tensioner 20 or to remove the ski boot from the binding and is possible without great exertion because of the resilience of the springs 14. It is thus solely necessary to make two hand actions in order to convert the binding for downhill skiing or to remove the cable once more from beneath the projection 18 to return the binding to the touring configuration.

An important feature of the invention can be seen from FIG. 3, namely the distance 'b' between the abutments 17 and the side projections 18. This distance specifies the vertical elasticity of the binding in the downhill configuration of FIG. 3. On the occurrence of a force which operates upwardly on the ski boot 19 the sole plate 11 can move away from the base plate 13 by overcoming the force of the spring 14 until the abutment 17 comes into contact with the projection 18. The ski boot is now blocked against further lifting movement. In this condition the springs no longer have any effect and are effectively neutralized. The release force for the ski boot in the upward direction is now determined solely by the safety release mechanism 25, 26, 28 and 29 which is arranged between the base plate 13 and the ski 24.

The safety release of the base plate is, however, not only ensured during downhill skiing but also in the touring configuration of the binding.

The adjustment for matching the cable to various shoe sizes can take place by means of screw threaded sleeves or bolts (not shown but well known per se) and which are incorporated in the cable train. An adjustment is also possible in the manner shown in FIG. 4 in which the pins or bolts 22 can be moved between the bores 21 and 21'. Naturally further bores can be provided as desired.

To allow one binding to be used for several ski boot sizes it is also convenient if the lugs or clips 15 and the side projections 18 can also be adjustably positioned on the sole plate and base plate respectively.

A particular advantage of the ski binding of the present teaching resides in the fact that not only can flexible ski boots be used because the safety release mechanism takes place via a rigid plate but also that the beneficial effect of the flexibility of the ski boot can also be utilized in the touring configuration because the flexible sole plate and the heel clamp for the ski boot 19 enable the flexing of the sole of the ski boot in the touring configuration.

It will be appreciated that several modifications can be made to the arrangement disclosed in the present specification without departing from the scope of the present teaching. For example, it is contemplated that the lugs or clips 15 can physically clamp the cable 12 to the side of the sole plate but in this case it is then necessary to build in some degree of resilience between the cable and the toggle lever tensioner. This can be done by either using a resilient portion in the cable or by the use of additional springs. It will also be appreciated that the toggle lever heel clamp arrangement can be divorced from the fitting which secures the sole plate to the base plate in the downhill configuration. Thus the cable loop for the toggle lever tensioner can be anchored to separate points on the sole plate whilst the cable for the side fittings is likewise simply anchored to the side of the sole plate.

I claim:

1. A ski safety binding which is convertible between downhill and touring configurations, the binding comprising a base plate connectable via a safety release mechanism to a ski, a sole plate to which a ski boot can be fastened arranged for pivotal movement about a transverse pivot axis on the base plate to define said touring configuration and at least one fitting provided on at least one side of the binding for securing the sole plate to the base plate in the downhill configuration, said fitting comprising a link incorporating a spring member at its forward portion and extending at least between a point of attachment at the forward part of the base plate and a point at which it is held to the side of the sole plate at the rear portion thereof, a projection on the base plate and which is disposed between said point of attachment and the point at which the link is held to the sole plate and somewhat below the latter and an abutment on the link which is located in front of and close to the projection when, to define the downhill configuration, the link is engaged beneath this projection.

2. A ski safety binding in accordance with claim 1 and characterized in that a said fitting is provided at each side of the binding.

3. A ski safety binding according to claim 1 and wherein the distance from the point at which the link is held to the sole plate to the point at which it is attached to the base plate lies in the range from three to five times the distance between its point of attachment to the base plate and said transverse pivot axis.

4. A ski safety binding in accordance with claim 2 and wherein the link associated with each said fitting comprises a cable passing from the spring element to a tensioner arranged at the heel of a ski boot and wherein the cable can slide relative to the point at which it is held to the sole plate and relative to said projection.

5. A ski safety binding in accordance with claim 4 and wherein the tensioner is formed as a toggle lever.

6. A ski safety binding in accordance with claim 4 and wherein the sole plate is flexibly constructed.

7. A ski safety binding according to claim 2 and wherein the points at which the link of each said fitting is held to the sole plate are adapted to simultaneously form a sideways abutment for the sole of the ski boot.

8. A ski safety binding according to claim 4 and wherein the projection associated with each fitting is spaced sufficiently far in front of the point at which the cable is held to the sole plate that the cable can be engaged and released by hand beneath the projection even when a ski boot is engaged within the binding and said tensioner is applying a tension to the cable.

9. A ski safety binding according to claim 4 and wherein the abutment provided in respect of each said fitting comprises a ring arranged on the cable.

10. A ski safety binding according to claim 1 and wherein said spring member comprises a tension spring extending between said abutment and the point of attachment of the link at the forward part of the base plate.

11. A ski safety binding according to claim 1 and wherein in the downhill configuration said spring member has a pretension in the range from 5 to 15 kp.

12. A ski safety binding according to claim 11 and wherein the spring member has a pre-tension of 10 kp.

13. A ski safety binding according to claim 11 and wherein said spring member has a spring constant in the range from 0.1 to 0.4 kp per mm.

14. A ski safety binding according to claim 13 and wherein said spring constant has a value of substantially 0.2 kp per mm.

15. A ski safety binding according to claim 1 and wherein a sole clamp is arranged at the forward region of the sole plate.

16. A ski safety binding according to claim 14 and wherein said sole clamp is formed as a wire loop.

17. A ski safety binding according to claim 1 and wherein said link is connectable to the base plate by means of bolts, screws or the like which are engageable in various positions in bores provided one after the other in the side of the base plate.

18. A ski safety binding according to claim 17 and wherein the connection between the link and the base plate is effected at the free end of the spring member incorporated in the link.

19. A ski safety binding according to claim 17 and wherein said base plate has several said side disposed bores arranged one behind the other and wherein said projection can be correspondingly positioned in various positions on the base plate.

20. A ski safety binding in accordance with claim 1 and wherein said abutment contacts said projection in the downhill configuration.

21. A ski safety binding in accordance with claim 1 and wherein said abutment is arranged at a predetermined small distance in front of said projection in the downhill configuration whereby to ensure a specified resilience of the binding.

22. A ski safety binding according to claim 4 and wherein said cable is common to both of said fittings.

23. A ski safety binding according to claim 4 and wherein a respective cable is provided in respect of each fitting the free ends of the two cables being connected to said tensioner.

* * * * *